US010375474B2

(12) United States Patent
Skramstad et al.

(10) Patent No.: US 10,375,474 B2
(45) Date of Patent: Aug. 6, 2019

(54) HYBRID HORN MICROPHONE

(71) Applicant: Cisco Technology, Inc., San Jose, CA (US)

(72) Inventors: Rune Skramstad, Drammen (NO); Haohai Sun, Nesbru (NO)

(73) Assignee: CISCO TECHNOLOGY, INC., San Jose, CA (US)

( * ) Notice: Subject to any disclaimer, the term of this patent is extended or adjusted under 35 U.S.C. 154(b) by 18 days.

(21) Appl. No.: 15/620,169

(22) Filed: Jun. 12, 2017

(65) Prior Publication Data

US 2018/0359562 A1 Dec. 13, 2018

(51) Int. Cl.

| | |
|---|---|
| ***H04R 3/00*** | (2006.01) |
| ***H04R 1/40*** | (2006.01) |
| ***H04R 1/30*** | (2006.01) |
| ***H04R 3/04*** | (2006.01) |
| *H04R 1/20* | (2006.01) |

(52) U.S. Cl.

CPC ..... *H04R 3/005* (2013.01); *H04R 1/30* (2013.01); *H04R 1/406* (2013.01); *H04R 3/04* (2013.01); *H04R 2201/401* (2013.01)

(58) Field of Classification Search

CPC ..... H04R 3/005; H04R 1/30; H04R 1/406; H04R 3/04; H04R 2201/401; G10L 21/0208; H03G 5/165

USPC ..... 381/92, 337

See application file for complete search history.

(56) References Cited

U.S. PATENT DOCUMENTS

| | | | |
|---|---|---|---|
| 4,460,807 | A | 7/1984 | Kerr et al. |
| 4,890,257 | A | 12/1989 | Anthias et al. |
| 4,977,605 | A | 12/1990 | Fardeau et al. |
| 5,293,430 | A | 3/1994 | Shiau et al. |
| 5,694,563 | A | 12/1997 | Belfiore et al. |
| 5,699,082 | A | 12/1997 | Marks et al. |
| 5,745,711 | A | 4/1998 | Kitahara et al. |
| 5,767,897 | A | 6/1998 | Howell |
| 5,825,858 | A | 10/1998 | Shaffer et al. |
| 5,874,962 | A | 2/1999 | de Judicibus et al. |

(Continued)

FOREIGN PATENT DOCUMENTS

| | | |
|---|---|---|
| CN | 101055561 | 10/2007 |
| CN | 101076060 | 11/2007 |

(Continued)

OTHER PUBLICATIONS

Nh acoustics, em32 Eigenmike® microphone array release notes (v15.0), Apr. 26, 2013 (Year: 2013).*

(Continued)

*Primary Examiner* — Xu Mei
*Assistant Examiner* — Ammar T Hamid
(74) *Attorney, Agent, or Firm* — Polsinelli PC

(57) ABSTRACT

The disclosed technology relates to a microphone array. The array comprises a plurality of microphones with each microphone having a horn portion. Each microphone of the array further comprises an instrument disposed at a distal end of the horn portion. Each instrument of the array is configured to convert sound waves into an electrical signal. The microphone array further comprises a beamforming signal processing circuit electrically coupled to each instrument and configured to create a plurality of beam signals based on respective electrical signals.

20 Claims, 4 Drawing Sheets

(56) References Cited

U.S. PATENT DOCUMENTS 5,889,671 A 3/1999 Autermann et al.
5,917,537 A 6/1999 Lightfoot et al.
5,995,096 A 11/1999 Kitahara et al.
6,023,606 A 2/2000 Monte et al.
6,040,817 A 3/2000 Sumikawa
6,075,531 A 6/2000 DeStefano
6,085,166 A 7/2000 Beckhardt et al.
6,191,807 B1 2/2001 Hamada et al.
6,300,951 B1 10/2001 Filetto et al.
6,392,674 B1 5/2002 Hiraki et al.
6,424,370 B1 7/2002 Courtney
6,463,473 B1 10/2002 Gubbi
6,553,363 B1 4/2003 Hoffman
6,554,433 B1 4/2003 Holler
6,573,913 B1 6/2003 Butler et al.
6,646,997 B1 11/2003 Baxley et al.
6,665,396 B1 12/2003 Khouri et al.
6,700,979 B1 3/2004 Washiya
6,711,419 B1 3/2004 Mori
6,754,321 B1 6/2004 Innes et al.
6,754,335 B1 6/2004 Shaffer et al.
RE38,609 E 10/2004 Chen et al.
6,816,464 B1 11/2004 Scott et al.
6,865,264 B2 3/2005 Berstis
6,938,208 B2 8/2005 Reichardt
6,978,499 B2 12/2005 Gallant et al.
7,046,134 B2 5/2006 Hansen
7,046,794 B2 5/2006 Piket et al.
7,058,164 B1 6/2006 Chan et al.
7,058,710 B2 6/2006 McCall et al.
7,062,532 B1 6/2006 Sweat et al.
7,085,367 B1 8/2006 Lang
7,124,164 B1 10/2006 Chemtob
7,149,499 B1 12/2006 Oran et al.
7,180,993 B2 2/2007 Hamilton
7,209,475 B1 4/2007 Shaffer et al.
7,340,151 B2 3/2008 Taylor et al.
7,366,310 B2 4/2008 Stinson et al.
7,418,664 B2 8/2008 Ben-Shachar et al.
7,441,198 B2 10/2008 Dempski et al.
7,478,339 B2 1/2009 Pettiross et al.
7,500,200 B2 3/2009 Kelso et al.
7,530,022 B2 5/2009 Ben-Shachar et al.
7,552,177 B2 6/2009 Kessen et al.
7,577,711 B2 8/2009 McArdle
7,584,258 B2 9/2009 Maresh
7,587,028 B1 9/2009 Broerman et al.
7,606,714 B2 10/2009 Williams et al.
7,606,862 B2 10/2009 Swearingen et al.
7,620,902 B2 11/2009 Manion et al.
7,634,533 B2 12/2009 Rudolph et al.
7,774,407 B2 8/2010 Daly et al.
7,792,277 B2 9/2010 Shaffer et al.
7,830,814 B1 11/2010 Allen et al.
7,840,013 B2 11/2010 Dedieu et al.
7,840,980 B2 11/2010 Gutta
7,881,450 B1 2/2011 Gentle et al.
7,920,160 B2 4/2011 Tamaru et al.
7,956,869 B1 6/2011 Gilra
7,986,372 B2 7/2011 Ma et al.
7,995,464 B1 8/2011 Croak et al.
8,059,557 B1 11/2011 Sigg et al.
8,081,205 B2 12/2011 Baird et al.
8,140,973 B2 3/2012 Sandquist et al.
8,169,463 B2 5/2012 Enstad et al.
8,219,624 B2 7/2012 Haynes et al.
8,274,893 B2 9/2012 Bansal et al.
8,290,998 B2 10/2012 Stienhans et al.
8,301,883 B2 10/2012 Sundaram et al.
8,340,268 B2 12/2012 Knaz
8,358,327 B2 1/2013 Duddy
8,423,615 B1 4/2013 Hayes
8,428,234 B2 4/2013 Knaz
8,433,061 B2 4/2013 Cutler
8,434,019 B2 4/2013 Nelson
8,456,507 B1 6/2013 Mallappa et al.
8,462,103 B1 6/2013 Moscovitch et al.
8,478,848 B2 7/2013 Minert
8,520,370 B2 8/2013 Waitzman, III et al.
8,625,749 B2 1/2014 Jain et al.
8,630,208 B1 1/2014 Kjeldaas
8,638,354 B2 1/2014 Leow et al.
8,645,464 B2 2/2014 Zimmet et al.
8,675,847 B2 3/2014 Shaffer et al.
8,694,587 B2 4/2014 Chaturvedi et al.
8,694,593 B1 4/2014 Wren et al.
8,706,539 B1 4/2014 Mohler
8,732,149 B2 5/2014 Lida et al.
8,738,080 B2 5/2014 Nhiayi et al.
8,751,572 B1 6/2014 Behforooz et al.
8,831,505 B1 9/2014 Seshadri
8,850,203 B2 9/2014 Sundaram et al.
8,860,774 B1 10/2014 Sheeley et al.
8,874,644 B2 10/2014 Allen et al.
8,890,924 B2 11/2014 Wu
8,892,646 B2 11/2014 Chaturvedi et al.
8,914,444 B2 12/2014 Hladik, Jr.
8,914,472 B1 12/2014 Lee et al.
8,924,862 B1 12/2014 Luo
8,930,840 B1 1/2015 Riskó et al.
8,947,493 B2 2/2015 Lian et al.
8,972,494 B2 3/2015 Chen et al.
9,003,445 B1 4/2015 Rowe
9,031,839 B2 5/2015 Thorsen et al.
9,032,028 B2 5/2015 Davidson et al.
9,075,572 B2 7/2015 Ayoub et al.
9,118,612 B2 8/2015 Fish et al.
9,131,017 B2 9/2015 Kurupacheril et al.
9,137,376 B1 9/2015 Basart et al.
9,143,729 B2 9/2015 Anand et al.
9,165,281 B2 10/2015 Orsolini et al.
9,197,701 B1 11/2015 Petrov et al.
9,197,848 B2 11/2015 Felkai et al.
9,201,527 B2 12/2015 Kripalani et al.
9,203,875 B2 12/2015 Huang et al.
9,204,099 B2 12/2015 Brown
9,219,735 B2 12/2015 Hoard et al.
9,246,855 B2 1/2016 Maehiro
9,258,033 B2 2/2016 Showering
9,268,398 B2 2/2016 Tipirneni
9,298,342 B2 3/2016 Zhang et al.
9,323,417 B2 4/2016 Sun et al.
9,335,892 B2 5/2016 Ubillos
9,349,119 B2 5/2016 Desai et al.
9,367,224 B2 6/2016 Ananthakrishnan et al.
9,369,673 B2 6/2016 Ma et al.
9,407,621 B2 8/2016 Vakil et al.
9,432,512 B2 8/2016 You
9,449,303 B2 9/2016 Underhill et al.
9,495,664 B2 11/2016 Cole et al.
9,513,861 B2 12/2016 Lin et al.
9,516,022 B2 12/2016 Borzycki et al.
9,525,711 B2 12/2016 Ackerman et al.
9,553,799 B2 1/2017 Tarricone et al.
9,563,480 B2 2/2017 Messerli et al.
9,609,030 B2 3/2017 Sun et al.
9,609,514 B2 3/2017 Mistry et al.
9,614,756 B2 4/2017 Joshi
9,640,194 B1 5/2017 Nemala et al.
9,667,799 B2 5/2017 Olivier et al.
9,674,625 B2 6/2017 Armstrong-Mutner
9,762,709 B1 9/2017 Snyder et al.
2001/0030661 A1 10/2001 Reichardt
2002/0018051 A1 2/2002 Singh
2002/0076003 A1 6/2002 Zellner et al.
2002/0078153 A1 6/2002 Chung et al.
2002/0140736 A1 10/2002 Chen
2002/0188522 A1 12/2002 McCall et al.
2003/0028647 A1 2/2003 Grosu
2003/0046421 A1 3/2003 Horvitz et al.
2003/0068087 A1 4/2003 Wu et al.
2003/0154250 A1 8/2003 Miyashita
2003/0174826 A1 9/2003 Hesse
2003/0187800 A1 10/2003 Moore et al.

(56) References Cited

U.S. PATENT DOCUMENTS

2003/0197739 A1 10/2003 Bauer
2003/0227423 A1 12/2003 Arai et al.
2004/0039909 A1 2/2004 Cheng
2004/0054885 A1 3/2004 Bartram et al.
2004/0098456 A1 5/2004 Krzyzanowski et al.
2004/0210637 A1 10/2004 Loveland
2004/0253991 A1 12/2004 Azuma
2004/0267938 A1 12/2004 Shoroff et al.
2005/0014490 A1 1/2005 Desai et al.
2005/0031136 A1* 2/2005 Du ..... H04R 3/005 381/92
2005/0048916 A1 3/2005 Suh
2005/0055405 A1 3/2005 Kaminsky et al.
2005/0055412 A1 3/2005 Kaminsky et al.
2005/0085243 A1 4/2005 Boyer et al.
2005/0099492 A1 5/2005 Orr
2005/0108328 A1 5/2005 Berkeland et al.
2005/0131774 A1 6/2005 Huxter
2005/0175208 A1* 8/2005 Shaw ..... H04R 1/30 381/340
2005/0215229 A1 9/2005 Cheng
2005/0226511 A1 10/2005 Short
2005/0231588 A1 10/2005 Yang et al.
2005/0286711 A1 12/2005 Lee et al.
2006/0004911 A1 1/2006 Becker et al.
2006/0020697 A1 1/2006 Kelso et al.
2006/0026255 A1 2/2006 Malamud et al.
2006/0083305 A1 4/2006 Dougherty et al.
2006/0084471 A1 4/2006 Walter
2006/0164552 A1 7/2006 Cutler
2006/0224430 A1 10/2006 Butt
2006/0250987 A1 11/2006 White et al.
2006/0271624 A1 11/2006 Lyle et al.
2007/0005752 A1 1/2007 Chawla et al.
2007/0021973 A1 1/2007 Stremler
2007/0025576 A1* 2/2007 Wen ..... H04R 1/083 381/361
2007/0041366 A1 2/2007 Vugenfirer et al.
2007/0047707 A1 3/2007 Mayer et al.
2007/0058842 A1 3/2007 Vallone et al.
2007/0067387 A1 3/2007 Jain et al.
2007/0091831 A1 4/2007 Croy et al.
2007/0100986 A1 5/2007 Bagley et al.
2007/0106747 A1 5/2007 Singh et al.
2007/0116225 A1 5/2007 Zhao et al.
2007/0139626 A1 6/2007 Saleh et al.
2007/0150453 A1 6/2007 Morita
2007/0168444 A1 7/2007 Chen et al.
2007/0198637 A1 8/2007 Deboy et al.
2007/0208590 A1 9/2007 Dorricott et al.
2007/0248244 A1 10/2007 Sato et al.
2007/0250567 A1 10/2007 Graham et al.
2008/0059986 A1 3/2008 Kalinowski et al.
2008/0068447 A1 3/2008 Mattila et al.
2008/0071868 A1 3/2008 Arenburg et al.
2008/0080532 A1 4/2008 O'Sullivan et al.
2008/0107255 A1 5/2008 Geva et al.
2008/0133663 A1 6/2008 Lentz
2008/0154863 A1 6/2008 Goldstein
2008/0209452 A1 8/2008 Ebert et al.
2008/0270211 A1 10/2008 Vander Veen et al.
2008/0278894 A1 11/2008 Chen et al.
2009/0012963 A1 1/2009 Johnson et al.
2009/0019374 A1 1/2009 Logan et al.
2009/0049151 A1 2/2009 Pagan
2009/0064245 A1 3/2009 Facemire et al.
2009/0075633 A1 3/2009 Lee et al.
2009/0089822 A1 4/2009 Wada
2009/0094088 A1 4/2009 Chen et al.
2009/0100142 A1 4/2009 Stern et al.
2009/0119373 A1 5/2009 Denner et al.
2009/0132949 A1 5/2009 Bosarge
2009/0193327 A1 7/2009 Roychoudhuri et al.
2009/0234667 A1 9/2009 Thayne
2009/0254619 A1 10/2009 Kho et al.
2009/0256901 A1 10/2009 Mauchly et al.
2009/0278851 A1 11/2009 Ach et al.
2009/0282104 A1 11/2009 O'Sullivan et al.
2009/0292999 A1 11/2009 LaBine et al.
2009/0296908 A1 12/2009 Lee et al.
2009/0306981 A1 12/2009 Cromack et al.
2009/0309846 A1 12/2009 Trachtenberg et al.
2009/0313334 A1 12/2009 Seacat et al.
2010/0005142 A1 1/2010 Xiao et al.
2010/0005402 A1 1/2010 George et al.
2010/0031192 A1 2/2010 Kong
2010/0061538 A1 3/2010 Coleman et al.
2010/0070640 A1 3/2010 Allen, Jr. et al.
2010/0073454 A1 3/2010 Lovhaugen et al.
2010/0077109 A1 3/2010 Yan et al.
2010/0094867 A1 4/2010 Badros et al.
2010/0095327 A1 4/2010 Fujinaka et al.
2010/0121959 A1 5/2010 Lin et al.
2010/0131856 A1 5/2010 Kalbfleisch et al.
2010/0157978 A1 6/2010 Robbins et al.
2010/0162170 A1 6/2010 Johns et al.
2010/0183179 A1 7/2010 Griffin, Jr. et al.
2010/0211872 A1 8/2010 Rolston et al.
2010/0215334 A1 8/2010 Miyagi
2010/0220615 A1 9/2010 Enstrom et al.
2010/0241691 A1 9/2010 Savitzky et al.
2010/0245535 A1 9/2010 Mauchly
2010/0250817 A1 9/2010 Collopy et al.
2010/0262266 A1 10/2010 Chang et al.
2010/0262925 A1 10/2010 Liu et al.
2010/0275164 A1 10/2010 Morikawa
2010/0302033 A1 12/2010 Devenyi et al.
2010/0303227 A1 12/2010 Gupta
2010/0316207 A1 12/2010 Brunson
2010/0318399 A1 12/2010 Li et al.
2011/0072037 A1 3/2011 Lotzer
2011/0075830 A1 3/2011 Dreher et al.
2011/0087745 A1 4/2011 O'Sullivan et al.
2011/0117535 A1 5/2011 Benko et al.
2011/0131498 A1 6/2011 Chao et al.
2011/0154427 A1 6/2011 Wei
2011/0230209 A1 9/2011 Kilian
2011/0264928 A1 10/2011 Hinckley
2011/0270609 A1 11/2011 Jones et al.
2011/0271211 A1 11/2011 Jones et al.
2011/0283226 A1 11/2011 Basson et al.
2011/0314139 A1 12/2011 Song et al.
2012/0009890 A1 1/2012 Curcio et al.
2012/0013704 A1 1/2012 Sawayanagi et al.
2012/0013768 A1* 1/2012 Zurek ..... H04R 3/005 348/231.4
2012/0026279 A1 2/2012 Kato
2012/0054288 A1 3/2012 Wiese et al.
2012/0072364 A1 3/2012 Ho
2012/0084714 A1 4/2012 Sirpal et al.
2012/0092436 A1 4/2012 Pahud et al.
2012/0140970 A1 6/2012 Kim et al.
2012/0179502 A1 7/2012 Farooq et al.
2012/0190386 A1 7/2012 Anderson
2012/0192075 A1 7/2012 Ebtekar et al.
2012/0233020 A1 9/2012 Eberstadt et al.
2012/0246229 A1 9/2012 Carr et al.
2012/0246596 A1 9/2012 Ording et al.
2012/0284635 A1 11/2012 Sitrick et al.
2012/0296957 A1 11/2012 Stinson et al.
2012/0303476 A1 11/2012 Krzyzanowski et al.
2012/0306757 A1 12/2012 Keist et al.
2012/0306993 A1 12/2012 Sellers-Blais
2012/0308202 A1 12/2012 Murata et al.
2012/0313971 A1 12/2012 Murata et al.
2012/0315011 A1 12/2012 Messmer et al.
2012/0321058 A1 12/2012 Eng et al.
2012/0323645 A1 12/2012 Spiegel et al.
2012/0324512 A1 12/2012 Cahnbley et al.
2013/0027425 A1 1/2013 Yuan
2013/0038675 A1 2/2013 Malik
2013/0047093 A1 2/2013 Reuschel et al.
2013/0050398 A1 2/2013 Krans et al.
2013/0055112 A1 2/2013 Joseph et al.

(56) References Cited

U.S. PATENT DOCUMENTS

| | | | |
|---|---|---|---|
| 2013/0061054 | A1 | 3/2013 | Niccolai |
| 2013/0063542 | A1 | 3/2013 | Bhat et al. |
| 2013/0086633 | A1 | 4/2013 | Schultz |
| 2013/0090065 | A1 | 4/2013 | Fisunenko et al. |
| 2013/0091205 | A1 | 4/2013 | Kotler et al. |
| 2013/0091440 | A1 | 4/2013 | Kotler et al. |
| 2013/0094647 | A1 | 4/2013 | Mauro et al. |
| 2013/0113602 | A1 | 5/2013 | Gilbertson et al. |
| 2013/0113827 | A1 | 5/2013 | Forutanpour et al. |
| 2013/0120522 | A1 | 5/2013 | Lian et al. |
| 2013/0124551 | A1 | 5/2013 | Foo |
| 2013/0129252 | A1 | 5/2013 | Lauper et al. |
| 2013/0135837 | A1 | 5/2013 | Kemppinen |
| 2013/0141371 | A1 | 6/2013 | Hallford et al. |
| 2013/0148789 | A1 | 6/2013 | Hillier et al. |
| 2013/0182063 | A1 | 7/2013 | Jaiswal et al. |
| 2013/0185672 | A1 | 7/2013 | McCormick et al. |
| 2013/0198629 | A1 | 8/2013 | Tandon et al. |
| 2013/0210496 | A1 | 8/2013 | Zakarias et al. |
| 2013/0211826 | A1 | 8/2013 | Mannby |
| 2013/0212202 | A1 | 8/2013 | Lee |
| 2013/0215215 | A1 | 8/2013 | Gage et al. |
| 2013/0219278 | A1 | 8/2013 | Rosenberg |
| 2013/0222246 | A1 | 8/2013 | Booms et al. |
| 2013/0225080 | A1 | 8/2013 | Doss et al. |
| 2013/0227433 | A1 | 8/2013 | Doray et al. |
| 2013/0235866 | A1 | 9/2013 | Tian et al. |
| 2013/0242030 | A1 | 9/2013 | Kato et al. |
| 2013/0243213 | A1 | 9/2013 | Moquin |
| 2013/0252669 | A1 | 9/2013 | Nhiayi |
| 2013/0263020 | A1 | 10/2013 | Heiferman et al. |
| 2013/0290421 | A1 | 10/2013 | Benson et al. |
| 2013/0297704 | A1 | 11/2013 | Alberth, Jr. et al. |
| 2013/0300637 | A1 | 11/2013 | Smits et al. |
| 2013/0325970 | A1 | 12/2013 | Roberts et al. |
| 2013/0329865 | A1 | 12/2013 | Ristock et al. |
| 2013/0335507 | A1 | 12/2013 | Aarrestad et al. |
| 2014/0012990 | A1 | 1/2014 | Ko |
| 2014/0028781 | A1 | 1/2014 | MacDonald |
| 2014/0040404 | A1 | 2/2014 | Pujare et al. |
| 2014/0040819 | A1 | 2/2014 | Duffy |
| 2014/0063174 | A1 | 3/2014 | Junuzovic et al. |
| 2014/0068452 | A1 | 3/2014 | Joseph et al. |
| 2014/0068670 | A1 | 3/2014 | Timmermann et al. |
| 2014/0078182 | A1 | 3/2014 | Utsunomiya |
| 2014/0108486 | A1 | 4/2014 | Borzycki et al. |
| 2014/0111597 | A1 | 4/2014 | Anderson et al. |
| 2014/0136630 | A1 | 5/2014 | Siegel et al. |
| 2014/0157338 | A1 | 6/2014 | Pearce |
| 2014/0161243 | A1 | 6/2014 | Contreras et al. |
| 2014/0195557 | A1 | 7/2014 | Oztaskent et al. |
| 2014/0198175 | A1 | 7/2014 | Shaffer et al. |
| 2014/0237371 | A1 | 8/2014 | Klemm et al. |
| 2014/0253671 | A1 | 9/2014 | Bentley et al. |
| 2014/0280595 | A1 | 9/2014 | Mani et al. |
| 2014/0282213 | A1 | 9/2014 | Musa et al. |
| 2014/0296112 | A1 | 10/2014 | O'Driscoll et al. |
| 2014/0298210 | A1 | 10/2014 | Park et al. |
| 2014/0317561 | A1 | 10/2014 | Robinson et al. |
| 2014/0337840 | A1 | 11/2014 | Hyde et al. |
| 2014/0358264 | A1 | 12/2014 | Long et al. |
| 2014/0372908 | A1 | 12/2014 | Kashi et al. |
| 2015/0004571 | A1 | 1/2015 | Ironside et al. |
| 2015/0009278 | A1 | 1/2015 | Modai et al. |
| 2015/0029301 | A1 | 1/2015 | Nakatomi et al. |
| 2015/0067552 | A1 | 3/2015 | Leorin et al. |
| 2015/0070835 | A1 | 3/2015 | Mclean |
| 2015/0074189 | A1 | 3/2015 | Cox et al. |
| 2015/0081885 | A1 | 3/2015 | Thomas et al. |
| 2015/0082350 | A1 | 3/2015 | Ogasawara et al. |
| 2015/0085060 | A1 | 3/2015 | Fish et al. |
| 2015/0088575 | A1 | 3/2015 | Asli et al. |
| 2015/0089393 | A1 | 3/2015 | Zhang et al. |
| 2015/0089394 | A1 | 3/2015 | Chen et al. |
| 2015/0113050 | A1 | 4/2015 | Stahl |
| 2015/0113369 | A1 | 4/2015 | Chan et al. |
| 2015/0128068 | A1 | 5/2015 | Kim |
| 2015/0172120 | A1 | 6/2015 | Dwarampudi et al. |
| 2015/0178626 | A1 | 6/2015 | Pielot et al. |
| 2015/0215365 | A1 | 7/2015 | Shaffer et al. |
| 2015/0254760 | A1 | 9/2015 | Pepper |
| 2015/0288774 | A1 | 10/2015 | Larabie-Belanger |
| 2015/0301691 | A1 | 10/2015 | Qin |
| 2015/0304120 | A1 | 10/2015 | Xiao et al. |
| 2015/0304366 | A1 | 10/2015 | Bader-Natal et al. |
| 2015/0319113 | A1 | 11/2015 | Gunderson et al. |
| 2015/0350126 | A1 | 12/2015 | Xue |
| 2015/0373063 | A1 | 12/2015 | Vashishtha et al. |
| 2015/0373414 | A1 | 12/2015 | Kinoshita |
| 2016/0037304 | A1 | 2/2016 | Dunkin et al. |
| 2016/0043986 | A1 | 2/2016 | Ronkainen |
| 2016/0044159 | A1 | 2/2016 | Wolff et al. |
| 2016/0044380 | A1 | 2/2016 | Barrett |
| 2016/0050079 | A1 | 2/2016 | Martin De Nicolas et al. |
| 2016/0050160 | A1 | 2/2016 | Li et al. |
| 2016/0050175 | A1 | 2/2016 | Chaudhry et al. |
| 2016/0070758 | A1 | 3/2016 | Thomson et al. |
| 2016/0071056 | A1 | 3/2016 | Ellison et al. |
| 2016/0072862 | A1 | 3/2016 | Bader-Natal et al. |
| 2016/0094593 | A1 | 3/2016 | Priya |
| 2016/0105345 | A1 | 4/2016 | Kim et al. |
| 2016/0110056 | A1 | 4/2016 | Hong et al. |
| 2016/0165056 | A1 | 6/2016 | Bargetzi et al. |
| 2016/0173537 | A1 | 6/2016 | Kumar et al. |
| 2016/0182580 | A1 | 6/2016 | Nayak |
| 2016/0266609 | A1 | 9/2016 | McCracken |
| 2016/0269411 | A1 | 9/2016 | Malachi |
| 2016/0277461 | A1 | 9/2016 | Sun et al. |
| 2016/0283909 | A1 | 9/2016 | Adiga |
| 2016/0307165 | A1 | 10/2016 | Grodum et al. |
| 2016/0309037 | A1 | 10/2016 | Rosenberg et al. |
| 2016/0321347 | A1 | 11/2016 | Zhou et al. |
| 2017/0006162 | A1 | 1/2017 | Bargetzi et al. |
| 2017/0006446 | A1 | 1/2017 | Harris et al. |
| 2017/0070706 | A1 | 3/2017 | Ursin et al. |
| 2017/0093874 | A1 | 3/2017 | Uthe |
| 2017/0104961 | A1 | 4/2017 | Pan et al. |
| 2017/0171260 | A1 | 6/2017 | Jerrard-Dunne et al. |
| 2017/0324850 | A1 | 11/2017 | Snyder et al. |

FOREIGN PATENT DOCUMENTS

| | | | |
|---|---|---|---|
| CN | 102572370 | | 7/2012 |
| CN | 102655583 | | 9/2012 |
| CN | 101729528 | | 11/2012 |
| CN | 102938834 | | 2/2013 |
| CN | 103141086 | | 6/2013 |
| CN | 204331453 | | 5/2015 |
| DE | 3843033 | C2 | 9/1991 |
| EP | 959585 | | 11/1999 |
| EP | 2773131 | A1 | 9/2014 |
| EP | 2341686 | | 8/2016 |
| WO | WO 98/55903 | | 12/1998 |
| WO | 2008/139269 | A1 | 11/2008 |
| WO | WO 2012/167262 | | 12/2012 |
| WO | WO 2014/118736 | | 8/2014 |

OTHER PUBLICATIONS

Mh acoustics em32 Eigennnike®, microphone array release notes (v15.0) , Apr. 27, 2013.*

Author Unknown, "A Primer on the H.323 Series Standard," Version 2.0, available at http://www.packetizer.com/voip/h323/papers/primer/, retrieved on Dec. 20, 2006, 17 pages.

Author Unknown, ""I can see the future" 10 predictions concerning cell-phones," Surveillance Camera Players, http://www.notbored.org/cell-phones.html, Jun. 21, 2003, 2 pages.

Author Unknown, "Active screen follows mouse and dual monitors," KDE Community Forums, Apr. 13, 2010, 3 pages.

Author Unknown, "Implementing Media Gateway Control Protocols" A RADVision White Paper, Jan. 27, 2002, 16 pages.

Author Unknown, "Manage Meeting Rooms in Real Time," Jan. 23, 2017, door-tablet.com, 7 pages.

(56) References Cited

OTHER PUBLICATIONS

Averusa, "Interactive Video Conferencing K-12 applications," "Interactive Video Conferencing K-12 applications" copyright 2012. http://www.averusa.com/education/downloads/hvc brochure goved.pdf (last accessed Oct. 11, 2013).
Choi, Jae Young, et al; "Towards an Automatic Face Indexing System for Actor-based Video Services in an IPTV Environment," IEEE Transactions on 56, No. 1 (2010): 147-155.
Cisco Systems, Inc. "Cisco webex: WebEx Meeting Center User Guide For Hosts, Presenters, and Participants" © 1997-2013, pp. 1-394 plus table of contents.
Cisco Systems, Inc., "Cisco Webex Meetings for iPad and iPhone Release Notes," Version 5.0, Oct. 2013, 5 pages.
Cisco Systems, Inc., "Cisco WebEx Meetings Server System Requirements release 1.5." 30 pages, Aug. 14, 2013.
Cisco Systems, Inc., "Cisco Unified Personal Communicator 8.5", 2011, 9 pages.
Cisco White Paper, "Web Conferencing: Unleash the Power of Secure, Real-Time Collaboration," pp. 1-8, 2014.
Clarke, Brant, "Polycom Announces RealPresence Group Series" "Polycom Announces RealPresence Group Series," dated Oct. 8, 2012 available at http://www.323.tv/news/polycom-realpresence-group-series (last accessed Oct. 11, 2013).
Clauser, Grant, et al., "Is the Google Home the voice-controlled speaker for you?," The Wire Cutter, Nov. 22, 2016, pp. 1-15.
Cole, Camille, et al., "Videoconferencing for K-12 Classrooms, Second Edition (excerpt)," http://www.iste.org/docs/excerpts/VIDCO2-excerpt.pdf (last accessed Oct. 11, 2013), 2009.
Eichen, Elliot, et al., "Smartphone Docking Stations and Strongly Converged VoIP Clients for Fixed-Mobile convergence," IEEE Wireless Communications and Networking Conference: Services, Applications and Business, 2012, pp. 3140-3144.
Epson, "BrightLink Pro Projector," BrightLink Pro Projector. http://www.epson.com/cgi-bin/Store/jsp/Landing/brightlink-pro-interactive-projectors.do?ref=van brightlink-pro—dated 2013 (last accessed Oct. 11, 2013).
Grothaus, Michael, "How Interactive Product Placements Could Save Television," Jul. 25, 2013, 4 pages.
Hannigan, Nancy Kruse, et al., The IBM Lotus Samteime VB Family Extending The IBM Unified Communications and Collaboration Strategy (2007), available at http://www.ibm.com/developerworks/lotus/library/sametime8-new/, 10 pages.
Hirschmann, Kenny, "TWIDDLA: Smarter Than The Average Whiteboard," Apr. 17, 2014, 2 pages.
Infocus, "Mondopad," Mondopad. http://www.infocus.com/sites/default/files/InFocus-Mondopad-INF5520a-INF7021-Datasheet-EN.pdf (last accessed Oct. 11, 2013), 2013.
Maccormick, John, "Video Chat with Multiple Cameras," CSCW '13, Proceedings of the 2013 conference on Computer supported cooperative work companion, pp. 195-198, ACM, New York, NY, USA, 2013.
Microsoft, "Positioning Objects on Multiple Display Monitors," Aug. 12, 2012, 2 pages.
Mullins, Robert, "Polycom Adds Tablet Videoconferencing," Mullins, R. "Polycom Adds Tablet Videoconferencing" available at http://www.informationweek.com/telecom/unified-communications/polycom-adds-tablet-videoconferencing/231900680 dated Oct. 12, 2011 (last accessed Oct. 11, 2013).
Nu-Star Technologies, "Interactive Whiteboard Conferencing," Interactive Whiteboard Conferencing. http://www.nu-star.com/interactive-conf.php dated 2013 (last accessed Oct. 11, 2013).
Nyamgondalu, Nagendra, "Lotus Notes Calendar And Scheduling Explained!" IBM, Oct. 18, 2004, 10 pages.
Polycom, "Polycom RealPresence Mobile: Mobile Telepresence & Video Conferencing," http://www.polycom.com/products-services/hd-telepresence-video-conferencing/realpresence-mobile.html#stab1 (last accessed Oct. 11, 2013), 2013.
Polycom, "Polycom Turns Video Display Screens into Virtual Whiteboards with First Integrated Whiteboard Solution for Video Collaboration," Polycom Turns Video Display Screens into Virtual Whiteboards with First Integrated Whiteboard Solution for Video Collaboration—http://www.polycom.com/company/news/press-releases/2011/20111027 2.html—dated Oct. 27, 2011.
Polycom, "Polycom UC Board, Transforming ordinary surfaces into virtual Whiteboards" 2012, Polycom, Inc., San Jose, CA, http://www.uatg.com/pdf/polycom/polycom-uc-board-_datasheet.pdf, (last accessed Oct. 11, 2013).
Schreiber, Danny, "The Missing Guide for Google Hangout Video Calls," Jun. 5, 2014, 6 pages.
Shervington, Martin, "Complete Guide to Google Hangouts for Businesses and Individuals," Mar. 20, 2014, 15 pages.
Shi, Saiqi, et al, "Notification That a Mobile Meeting Attendee Is Driving", May 20, 2013, 13 pages.
Stevenson, Nancy, "Webex Web Meetings for Dummies" 2005, Wiley Publishing Inc., Indianapolis, Indiana, USA, 339 pages.
Stodle. Daniel, et al., "Gesture-Based, Touch-Free Multi-User Gaming on Wall-Sized, High-Resolution Tiled Displays," 2008, 13 pages.
Thompson, Phil, et al., "Agent Based Ontology Driven Virtual Meeting Assistant," Future Generation Information Technology, Springer Berlin Heidelberg, 2010, 4 pages.
TNO, "Multi-Touch Interaction Overview," Dec. 1, 2009, 12 pages.
Toga, James, et al., "Demystifying Multimedia Conferencing Over the Internet Using the H.323 Set of Standards," Intel Technology Journal Q2, 1998, 11 pages.
Ubuntu, "Force Unity to open new window on the screen where the cursor is?" Sep. 16, 2013, 1 page.
VB Forums, "Pointapi," Aug. 8, 2001, 3 pages.
Vidyo, "VidyoPanorama," VidyoPanorama-http://www.vidyo.com/products/vidyopanorama/ dated 2013 (last accessed Oct. 11, 2013).

* cited by examiner

HYBRID HORN MICROPHONE

TECHNICAL FIELD

This present disclosure relates generally to microphones, and more particularly to a horn microphone utilizing beamforming signal processing.

BACKGROUND

A Microphone converts air pressure variations of a sound wave into an electrical signal. A variety of methods may be used to convert a sound wave into an electrical signal, such as use of a coil of wire with a diaphragm suspended in a magnetic field, use of a vibrating diaphragm as a capacitor plate, use of a crystal of piezoelectric material, or use of a permanently charged material. Conventional microphones may sense sound waves from all directions (e.g. omni microphone), in a 3D axis symmetric figure of eight pattern (e.g. dipole microphone), or primarily in one direction with a fairly large pickup pattern (e.g. cardioid, super cardioid and hyper cardioid microphones).

In audio and video conferencing applications involving multiple participants in a given location, uni-directional microphones are undesired. In addition, participants desire speech intelligibility and sound quality without requiring a multitude of microphones placed throughout a conference room. Placing a plurality of microphones in varying locations within a room requires among other things, lengthy cables, cable management, and additional hardware.

Further, conventional microphone arrays require sophisticated and costly hardware, significant computing performance, complex processing, and may nonetheless lack adequate sound quality when compared to use of multiple microphones placed throughout a room. Moreover, conventional microphone arrays may experience processing artifacts caused by high-frequency spatial aliasing issues.

BRIEF DESCRIPTION OF THE DRAWINGS

The embodiments herein may be better understood by referring to the following description in conjunction with the accompanying drawings in which like reference numerals indicate identical or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

Figure 1:
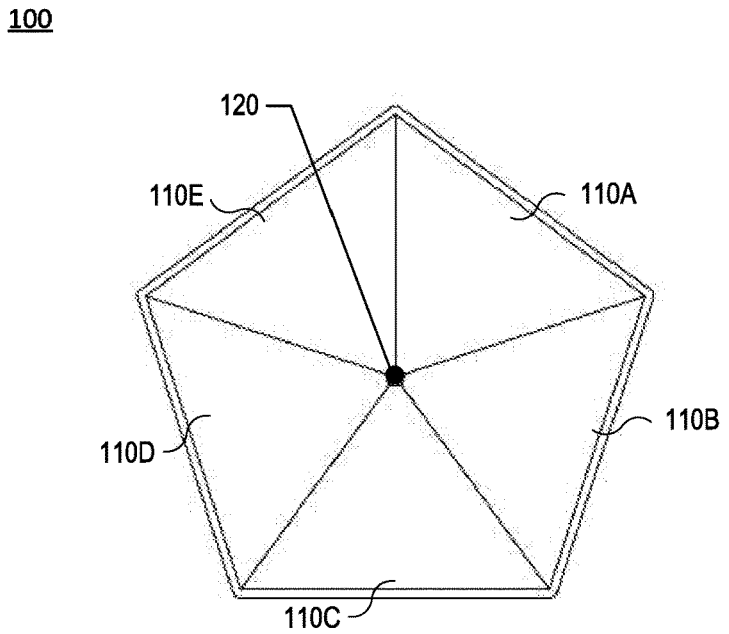
FIG. 1 is a top view of a hybrid horn microphone, in accordance with various aspects of the subject technology.

The detailed description set forth below is intended as a description of various configurations of embodiments and is not intended to represent the only configurations in which the subject matter of this disclosure can be practiced. The appended drawings are incorporated herein and constitute a part of the detailed description. The detailed description includes specific details for the purpose of providing a more thorough understanding of the subject matter of this disclosure. However, it will be clear and apparent that the subject matter of this disclosure is not limited to the specific details set forth herein and may be practiced without these details. In some instances, structures and components are shown in block diagram form in order to avoid obscuring the concepts of the subject matter of this disclosure.

Overview

Conventional microphones may sense sound waves from all directions (e.g. omni microphone), in a 3D axis symmetric figure of eight pattern (e.g. dipole microphone), or primarily in one direction with a fairly large pickup pattern (e.g. cardioid, super cardioid and hyper cardioid microphones). In applications where sensing of sound from various locations may be required, an array of microphones may be positioned in a central location, such as on the middle of a table in a room. Conventional microphone arrays require sophisticated and costly hardware, significant computing performance, complex processing, and may lack adequate sound quality when compared to use of multiple microphones placed throughout a room or assigned to individual participants or users. In addition, conventional microphone arrays may have a shorter critical distance, that is, the distance in which the microphone array may adequately sense sound due to the sound pressure level of the direct sound and the reverberant sound being equal when dealing with a directional source, when compared to the hybrid horn microphone of the subject technology. Moreover, a conventional microphone array may experience processing artifacts caused by high-frequency spatial aliasing issues.

The disclosed technology addresses the need in the art for providing a high-sensitive and anti-aliasing microphone by combining horn technology and beamforming signal processing. In an array configuration, the hybrid horn microphone of the subject technology requires less processing power compared to conventional microphone arrays. In addition, the hybrid microphone of the subject technology has a higher signal to noise ratio and less high frequency spatial-aliasing issues than other implementations. The hybrid horn microphone array of the subject technology also has a longer critical distance and increased sound quality compared to conventional microphone arrays.

In addition, the hybrid horn microphone array of the subject technology does not require multiple arrays, may utilize a single output cable, and may be installed in a single location in a room, such as on or near the ceiling. There is no need for multiple microphones to be located, installed and wired throughout a room. Further, users do not need to reposition table microphones to improve sound quality as the subject technology is capable of processing audio signals to create high quality sound.

DETAILED DESCRIPTION

Various aspects of the disclosure are discussed in detail below. While specific implementations are discussed, it should be understood that this is done for illustration purposes only. A person skilled in the relevant art will recognize that other components and configurations may be used without parting from the spirit and scope of the disclosure.

FIG. 1 is a top view of a hybrid horn microphone 100, in accordance with various aspects of the subject technology. Microphone 100 comprises a horn portion that is formed by a plurality of planar surfaces 110A-E. The planar surfaces 110A-E are arranged in a converging orientation to form a shape having a first opening on a proximal end and a second opening on a distal end, the second opening at the distal end being smaller in area than the first opening at the proximal end.

The plurality of planar surfaces 110 may be substantially planar and devoid of curvature such that a cross-sectional area of the horn portion from the proximal end to the distal end decreases at a constant rate. In some aspects, the planar surfaces may include curvature such that the cross-sectional area of the horn portion from the proximal end to the distal end decreases with varying rates.

The plurality of planar surfaces 110 may be made of polymer, composite, metal, alloys, or a combination thereof. It is understood that other materials may be used to form the horn portion without deviating from the scope of the subject technology.

Each planar surface 110 of the plurality of planar surfaces 110A-E may have substantially the same thickness. The thickness of each planar surface 110 may be 0.13", 0.25", 0.38", or 0.5". It is understood that the planar surfaces 110 may have other values for thickness without departing from the scope of the subject technology.

In some aspects, the length of the planar surface 110 may range from 4-6 inches, 6-8 inches, 8-10 inches, 10-12 inches or 12-14 inches. It is understood that the planar surface 110 may have a longer length without departing from the scope of the subject technology. In one aspect, a width of the planar surface is similar to the length of the planar surface.

In one aspect, the horn portion may be formed by a single component, folded, cast, or molded into the desired shape. For example, the horn portion may comprise sheet metal folded into a pentagonal pyramid having five planar surfaces 110A-E. In another aspect, the horn portion may be assembled from multiple components with each component comprising the planar surface 110.

Figure 2:
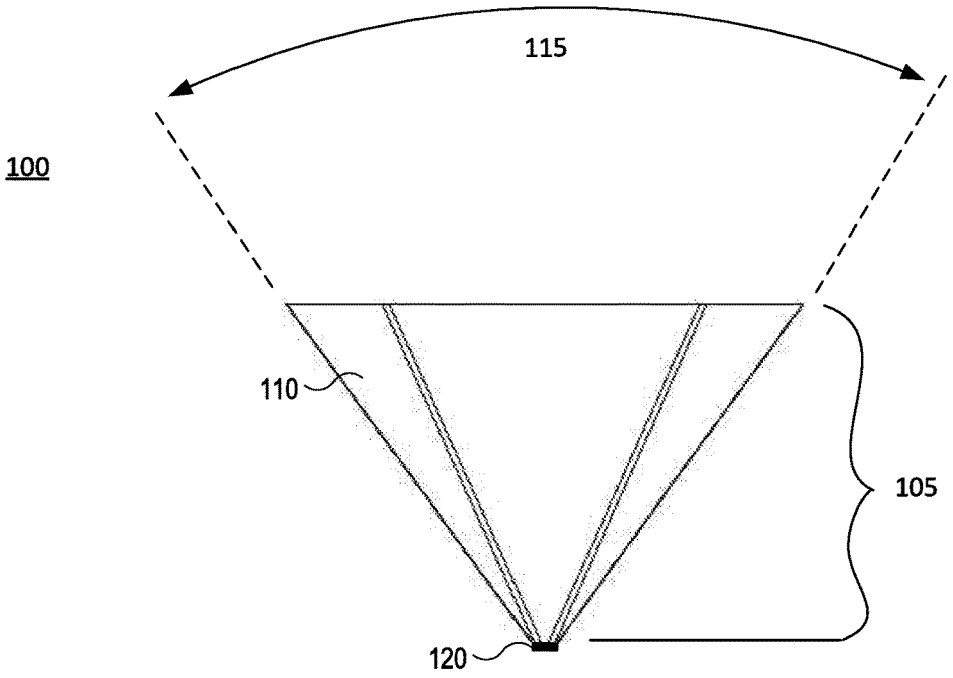
FIG. 2 is a front view of a hybrid horn microphone, in accordance with various aspects of the subject technology.

FIG. 2 is a front view of the hybrid horn microphone 100, in accordance with various aspects of the subject technology. The microphone 100 includes an instrument 120 disposed at the distal end of the horn portion 105. The distal end is located where the planar surfaces 110A-E converge to form a narrow opening. The instrument 120 is configured to detect sound waves and convert air pressure variations of a sound wave into an electrical signal. The instrument 120 may comprise an electret microphone. An electret microphone is a type of electrostatic capacitor-based microphone.

Sound waves emitted by a source, such as a user speaking at a telephonic or video conference, are directed or reflected towards the horn portion 105 and are directed to the instrument 120 by the shape of the planar surfaces 110A-E. In one aspect, the size and shape of the horn portion 105 correlates to a frequency range or bandwidth of the sound waves desired for detection.

In another aspect, by utilizing the horn portion 105, the microphone 100 detects and senses sound waves directionally. That is, the microphone 100 is capable of detecting sound waves from a source located within a detection range 115, while minimizing detection of sound waves from other sources that may be located at different locations from the source, outside of the detection range 115. By utilizing the horn portion 105, the microphone 100 is also able to prevent detection of ambient noise (typically greater than 10 dB) coming from sources located outside of the detection range. In one aspect, the horn portion 105 of the microphone 100 significantly reduces detection of sound waves coming from angles outside of the direction of the microphone 100 because the sound waves from outside the direction of the microphone 100 are reflected away from the instrument 120 by the horn portion 105. In another aspect, for sound waves coming from a source located within the detection range 115 of the microphone 100, a Signal to Noise Ratio (SNR) of the sound wave is significantly higher (generally 9 dB or more) than conventional microphones resulting in increased sound quality. In one aspect, for sound waves coming from a source within the detection range 115, the microphone 100 has a very high directivity at frequencies above 2 kHz.

In some aspects, the horn portion 105 may have various shapes formed by the planar surfaces 110. For example, the shape of the horn portion 105 formed by the plurality of planar surfaces 110 may comprise a triangular pyramid having three interior faces. In another example, the shape of the horn portion 105 formed by the plurality of planar surfaces 110 may comprise a square pyramid having four interior faces. In yet another example, the shape of the horn portion 105 formed by the plurality of planar surfaces 110 may comprise a pentagonal pyramid having five interior faces. In another example, the shape of the horn portion 105 formed by the plurality of planar surfaces 110 may comprise a hexagonal pyramid having six interior faces. In yet another example, the shape of the horn portion 105 formed by the plurality of planar surfaces 110 may comprise a heptagonal pyramid having seven interior faces. In another example, the shape of the horn portion 105 formed by the plurality of planar surfaces 110 may comprise an octagonal pyramid having eight interior faces. It is further understood that other shapes may be formed by the plurality of planar surfaces 110 as desired by a person of ordinary skill in the art.

Figure 3:
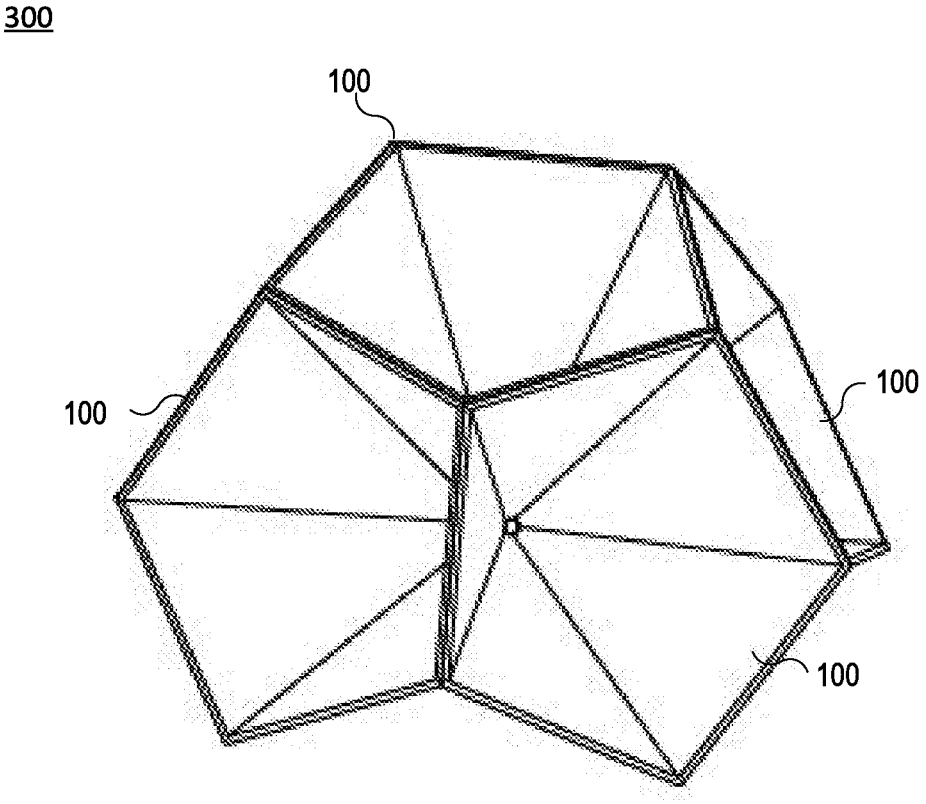
FIG. 3 is a perspective view of a hybrid horn microphone array, in accordance with various aspects of the subject technology.

FIG. 3 is a perspective view of a hybrid horn microphone array 300, in accordance with various aspects of the subject technology. In some aspects, the horn microphone 100 may be arranged in an array 300 to receive sound waves from one or more sources located within an area, such as a conference room. For example, the array 300 of microphones 100 may be arranged to form a polyhedron shape, such as a full dodecahedron that may be formed by arranging twelve microphones 100 into a full sphere dodecahedron arrangement. In another example, the polyhedron shape may comprise a half dodecahedron that may be formed by arranging six microphones 100 into a half dodecahedron arrangement (as shown in FIG. 3). In yet another example, the polyhedron shape may comprise a quarter dodecahedron formed by arranging three microphones 100 into a quarter dodecahedron arrangement. It is understood that the array 300 may comprise other shapes and may be formed of a multitude of microphones 100, including up to 120 microphones 100. In one aspect, the higher the number of microphones 100 comprising the array, the narrower the detection of sound waves from the source.

Each microphone 100 of the array 300 is pointed at a different direction, as shown in FIG. 3. In some aspects, by forming the array 300 with the plurality of microphones 100 arranged so that each microphone 100 is pointed at a different direction, each microphone 100 is configured to detect sound waves from the direction the microphone is pointed.

Figure 4:
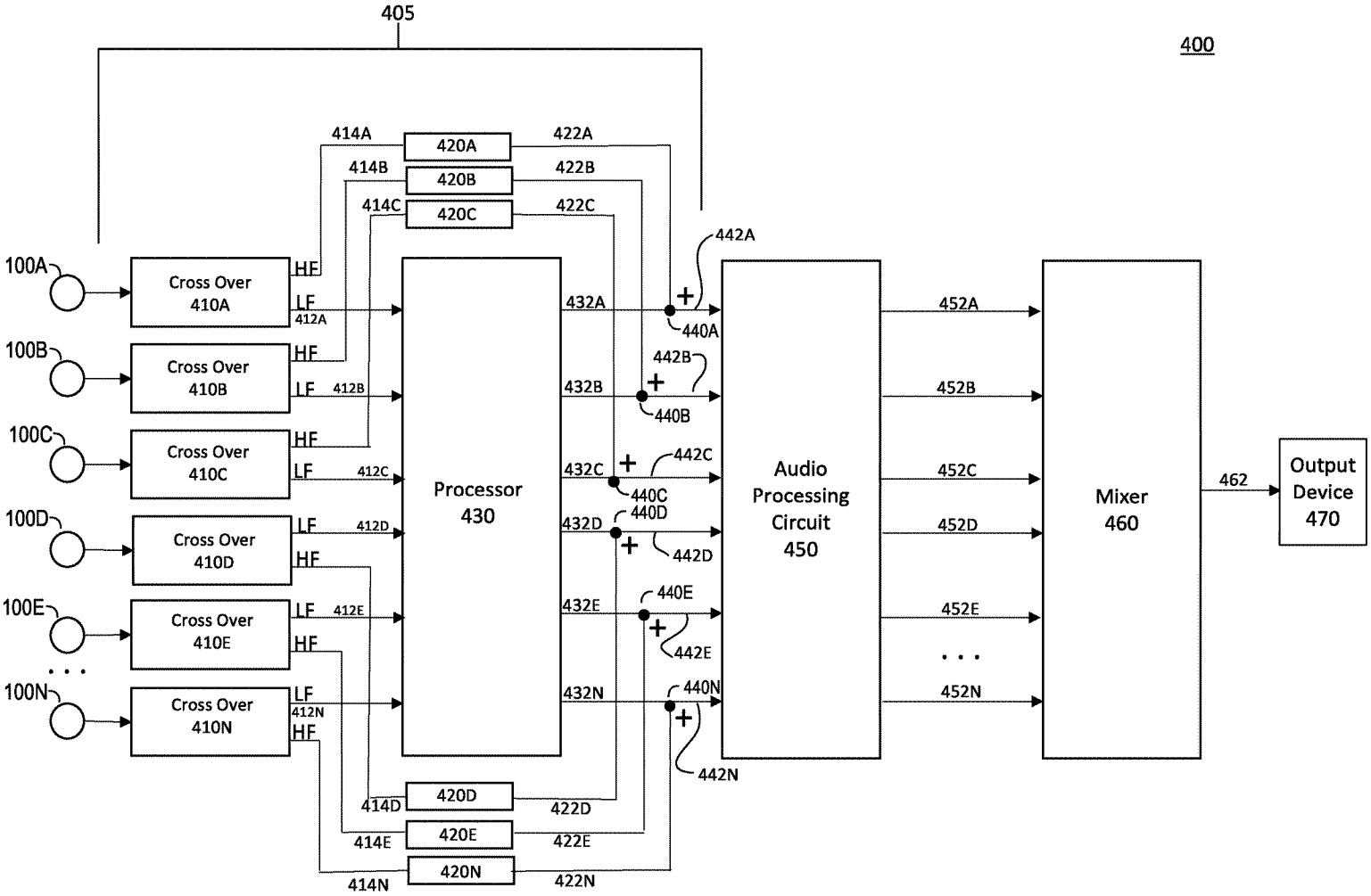
FIG. 4 depicts a hybrid horn microphone array processing block diagram, in accordance with various aspects of the subject technology.

FIG. 4 depicts a hybrid horn microphone array processing block diagram 400, in accordance with various aspects of the subject technology. The microphone array 300 (shown in FIG. 3) may further comprise the hybrid horn microphone array processing block diagram 400 to process the electrical signals generated by the instrument 120 (shown in FIGS. 1 and 2) of each microphone 100. In one aspect, the functions and operations depicted in the hybrid horn microphone array processing block diagram 400 may be performed by components mounted to the array 300, components located at a remote location, or at an output device as discussed further below.

The hybrid horn microphone array processing block diagram 400 comprises a beamforming signal processing circuit 405 for creating a high-sensitivity and anti-aliasing microphone array 300. The beamforming signal processing circuit 405 is electrically coupled to each microphone 100 and is configured to receive the electrical signals from each instrument 120. The beamforming signal processing circuit 405 is further configured to create beam signals corresponding to each microphone 100 based on the respective electrical signals. In some aspects, the beam signals are indicative of a location of a source of the sound waves detected by each microphone 100.

The beamforming signal processing circuit 405 comprises a crossover filter 410, a delaying circuit 420, a processor 430, and a mixer 440. Each electrical signal from the microphones 100A-N passes through respective cross over filters 410A-N. Each crossover filter 410A-N is configured to convert the respective electrical signals from the microphone 100A-N to a first signal 412 and a second signal 414, with the first and second signals, 412 and 414 respectively, having different frequencies or sub-bands. For example, the frequency of each respective first signal 412 may be below 2 kHz and the frequency of each respective second signal 414 may be above 2 kHz. In one aspect, the crossover frequency can be adapted to the size of the horn portion 105 (as shown in FIG. 2) of the microphone 100 in the array 300.

For example, with reference to a first microphone 100A, the electrical signal from the microphone 100A is received by the cross over filter 410A. The cross over filter 410A converts the electrical signal from the microphone 100A into a first signal 412A (Low Frequency or LF) and a second signal 414A (High Frequency or HF). With reference to a second microphone 100B, the electrical signal from the microphone 100B is received by the cross over filter 410B. The cross over filter 410B converts the electrical signal from the microphone 100B into a first signal 412B (Low Frequency or LF) and a second signal 414B (High Frequency or HF). With reference to a third microphone 100C, the electrical signal from the microphone 100C is received by the cross over filter 410C. The cross over filter 410C converts the electrical signal from the microphone 100C into a first signal 412C (Low Frequency or LF) and a second signal 414C (High Frequency or HF). With reference to a fourth microphone 100D, the electrical signal from the microphone 100D is received by the cross over filter 410D. The cross over filter 410D converts the electrical signal from the microphone 100D into a first signal 412D (Low Frequency or LF) and a second signal 414D (High Frequency or HF). With reference to a fifth microphone 100E, the electrical signal from the microphone 100E is received by the cross over filter 410E. The cross over filter 410E converts the electrical signal from the microphone 100E into a first signal 412E (Low Frequency or LF) and a second signal 414E (High Frequency or HF). In some aspects, any number of microphones 100N may be connected to the beamforming signal processing circuit 405, including the cross over filter 410N to convert the electrical signal from the microphone 100N into a first signal 412N and a second signal 414N, without departing from the scope of the subject technology.

The delaying circuit 420 is configured to delay the second signal 414 from the crossover filter 410 to create a delayed second signal 422. In some aspects, the delaying circuit is configured to sufficiently delay the second signal 414 so that upon mixing by the mixer 440, as discussed further below, the mixed signal is sufficiently aligned. Each second signal 414A-N from the respective cross over filters 410A-N is received by corresponding delaying circuits 420A-N to create respective delayed second signals 422A-N.

For example, with reference to the first microphone 100A, the second signal 414A from the cross over filter 410A is received by the delaying circuit 420A. The delaying circuit 420A delays the second signal 414A to create a delayed second signal 422A. With reference to the second microphone 100B, the second signal 414B from the cross over filter 410B is received by the delaying circuit 420B. The delaying circuit 420B delays the second signal 414B to create a delayed second signal 422B. With reference to the third microphone 100C, the second signal 414C from the cross over filter 410C is received by the delaying circuit 420C. The delaying circuit 420C delays the second signal 414C to create a delayed second signal 422C. With reference to the fourth microphone 100D, the second signal 414D from the cross over filter 410D is received by the delaying circuit 420D. The delaying circuit 420D delays the second signal 414D to create a delayed second signal 422D. With reference to the fifth microphone 100E, the second signal 414E from the cross over filter 410E is received by the delaying circuit 420E. The delaying circuit 420E delays the second signal 414E to create a delayed second signal 422E. In some aspects, any number of microphones 100N may be connected to the beamforming signal processing circuit 405, including the delaying circuit 420N to delay the second signal 414N and create a delayed second signal 422N, without departing from the scope of the subject technology.

The processor 430 may be configured to downsample the first signal 412 from the crossover filter 410 to create a downsampled first signal, process the downsampled first signal to create a processed first signal that is indicative of the location of the source of the sound waves detected by the microphone 100, and upsample the processed first signal to create an upsampled first signal 432. Each first signal 412A-N from the respective cross over filters 410A-N is received by the processor 430 to create the processed first signal 432A-N.

In some aspects, the processor 430 utilizes beamforming signal processing techniques to process the first signals 412A-N. Beam forming signal processing may be used to extract sound sources in an area or room. This may be achieved by combining elements in a phased array in such a way that signals at particular angles experience constructive interference while others experience destructive interference.

In one aspect, because the horn portion 105 (as shown in FIG. 2) of the microphone 100 significantly reduces detection of sound waves coming from angles outside of the direction of the microphone 100, provides a high SNR for sound waves coming from a source located within the detection range 115 (as shown in FIG. 2), and provides a very high directivity at frequencies above 2 kHz; no processing is required by the processor 430 for the second signals 414A-N. In one aspect, because no processing is required for the second signals 414A-N, spatial aliasing issues are avoided.

The processor 430 may downsample each of the first signals 412A-N to a lower sampling rate such as from 48 kHz to 4 kHz, which may significantly reduce computational complexity by 90%. The processor 430 may then filter and sum (or weight and sum in the frequency domain) each of the first signals 412A-N to create respective processed first signals representing acoustic beams pointing in the direction of each respective microphone. In another example, the processer 430 may use spherical harmonics theory or sound field models to create respective processed first signals representing acoustic beams pointing in the direction of each respective microphone. In one aspect, the processor 430 may measure the array response vectors for various sound arrival angles in an anechoic chamber. In another aspect, the processor 430 may implement various types of beam pattern synthesis/optimization or machine learning. The processor 430 may then upsample the processed first signals to obtain respective upsampled first signals 432 with a desired sampling rate.

For example, with reference to the first microphone 100A, the first signal 412A from the cross over filter 410A is received by the processor 430. The processor 430 may downsample the first signal 412A to create a first downsampled first signal. The processor 430 may then filter and sum (or weight and sum in the frequency domain) the first downsampled first signal to create a first processed first signal representing an acoustic beam pointing in the direction of microphone 100A. The first processed first signal indicative of the location of the source of the sound waves detected by the microphone 100A. The processor 430 may then upsample the first processed first signal to obtain an upsampled first signal 432A. With respect to the second microphone 100B, the first signal 412B from the cross over filter 410B is received by the processor 430. The processor 430 may downsample the first signal 412B to create a second downsampled first signal. The processor 430 may then filter and sum (or weight and sum in the frequency domain) the second downsampled first signal to create a second processed first signal representing an acoustic beam pointing in the direction of microphone 100B. The second processed first signal indicative of the location of the source of the sound waves detected by the microphone 100B. The processor 430 may then upsample the second processed first signal to obtain an upsampled first signal 432B. With respect to the third microphone 100C, the first signal 412C from the cross over filter 410C is received by the processor 430. The processor 430 may downsample the first signal 412C to create a third downsampled first signal. The processor 430 may then filter and sum (or weight and sum in the frequency domain) the third downsampled first signal to create a third processed first signal representing an acoustic beam pointing in the direction of microphone 100C. The third processed first signal indicative of the location of the source of the sound waves detected by the microphone 100C. The processor 430 may then upsample the third processed first signal to obtain an upsampled first signal 432C. With respect to the fourth microphone 100D, the first signal 412D from the cross over filter 410D is received by the processor 430. The processor 430 may downsample the first signal 412D to create a fourth downsampled first signal. The processor 430 may then filter and sum (or weight and sum in the frequency domain) the fourth downsampled first signal to create a fourth processed first signal representing an acoustic beam pointing in the direction of microphone 100D. The fourth processed first signal indicative of the location of the source of the sound waves detected by the microphone 100D. The processor 430 may then upsample the fourth processed first signal to obtain an upsampled first signal 432D. With respect to the fifth microphone 100E, the first signal 412E from the cross over filter 410E is received by the processor 430. The processor 430 may downsample the first signal 412E to create a fifth downsampled first signal. The processor 430 may then filter and sum (or weight and sum in the frequency domain) the fifth downsampled first signal to create a fifth processed first signal representing an acoustic beam pointing in the direction of microphone 100E. The fifth processed first signal indicative of the location of the source of the sound waves detected by the microphone 100E. The processor 430 may then upsample the fifth processed first signal to obtain an upsampled first signal 432E. In some aspects, any number of microphones 100N may be connected to the beamforming signal processing circuit 405, including the processor 430 to downsample, process and upsample the first signal 412N and create a upsampled first signal 432N, without departing from the scope of the subject technology.

The mixer 440 is configured to combine the upsampled first signal 432 from the processor 430 and the delayed second signal 422 from the delaying circuit 420 to create a full-band beam signal 442. Each upsampled first signal 432A-N and delayed second signal 422A-N from the respective delaying circuits 420A-N is received by corresponding mixers 440A-N to create respective full-band beam signals 442A-N.

For example, with reference to the first microphone 100A, the upsampled first signal 432A from the processor 430 and the delayed second signal 422A from the delaying circuit 420A is received by the mixer 440A. The mixer 440A combines the upsampled first signal 432A and the delayed second signal 422A to create a beam signal 442A. With reference to the second microphone 100B, the upsampled first signal 432B from the processor 430 and the delayed second signal 422B from the delaying circuit 420B is received by the mixer 440B. The mixer 440B combines the upsampled first signal 432B and the delayed second signal 422B to create a beam signal 442B. With reference to the third microphone 100C, the upsampled first signal 432C from the processor 430 and the delayed second signal 422C from the delaying circuit 420C is received by the mixer 440C. The mixer 440C combines the upsampled first signal 432C and the delayed second signal 422C to create a beam signal 442C. With reference to the fourth microphone 100D, the upsampled first signal 432D from the processor 430 and the delayed second signal 422D from the delaying circuit 420D is received by the mixer 440D. The mixer 440D combines the upsampled first signal 432D and the delayed second signal 422D to create a beam signal 442D. With reference to the second microphone 100E, the upsampled first signal 432E from the processor 430 and the delayed second signal 422E from the delaying circuit 420E is received by the mixer 440E. The mixer 440E combines the upsampled first signal 432E and the delayed second signal 422E to create a beam signal 442E. In some aspects, any number of microphones 100N may be connected to the beamforming signal processing circuit 405, including the mixer 440N to combine the upsampled first signal 432N and delayed second signal 422N to create the beam signal 442N, without departing from the scope of the subject technology.

The hybrid horn microphone array processing block diagram 400 may further comprise an audio processing circuit 450. The audio processing circuit 450 may be configured to receive each of the beam signals 442A-N and perform at least one of an echo control filter, a reverberation filter, or a noise reduction filter, to improve the quality of the beam signals 442A-N and create pre-mixed beam signals 452A-N.

For example, with reference to the first microphone 100A, the beam signal 442A from the mixer 440A is received by the audio processing circuit 450. The audio processing circuit 450 performs operations such as echo modification, reverberation adjustment, or noise reduction, to improve the quality of the beam signal 442A, and thereby create a pre-mixed beam signal 452A. With reference to the second microphone 100B, the beam signal 442B from the mixer 440B is received by the audio processing circuit 450. The audio processing circuit 450 performs operations such as echo modification, reverberation adjustment, or noise reduction, to improve the quality of the beam signal 442B, and thereby create a pre-mixed beam signal 452B. With reference to the third microphone 100C, the beam signal 442C from the mixer 440C is received by the audio processing circuit 450. The audio processing circuit 450 performs operations such as echo modification, reverberation adjustment, or noise reduction, to improve the quality of the beam signal 442C, and thereby create a pre-mixed beam signal 452C. With reference to the fourth microphone 100D, the beam signal 442D from the mixer 440D is received by the audio processing circuit 450. The audio processing circuit 450 performs operations such as echo modification, reverberation adjustment, or noise reduction, to improve the quality of the beam signal 442D, and thereby create a pre-mixed beam signal 452D. With reference to the fifth microphone 100E, the beam signal 442E from the mixer 440E is received by the audio processing circuit 450. The audio processing circuit 450 performs operations such as echo modification, reverberation adjustment, or noise reduction, to improve the quality of the beam signal 442E, and thereby create a pre-mixed beam signal 452E. In some aspects, any number of microphones 100N may be connected to the audio processing circuit 450 to improve the quality of the beam signal 442N and create pre-mixed beam signal 452N, without departing from the scope of the subject technology.

The hybrid horn microphone array processing block diagram 400 may further comprise an automatic mixer 460. The automatic mixer 460 may be configured to receive the plurality of pre-mixed beam signals 452A-N and identify one or more beam signals from the plurality of beam signals 452A-N to output to an output device 470 based on a characteristic of the beam signal 452A-N. The characteristic of the beam signal 452A-N may include, for example, quality, level, clarity, strength, SNR, signal to reverberation ratio, amplitude, wavelength, frequency, or phase. In some aspects, the mixer 460 may be configured to review each incoming pre-mix beam signal 452A-N, identify one or more beam signals 452A-N based on one or more characteristic of the beam signals 452A-N, select the one or more beam signals 452A-N, isolate signals representing speech, filter low signals that may not represent speech, and transmit an output signal 462 to the output device 470. In one aspect, the mixer 460 may utilize audio selection techniques to generate the desired audio output signal 462 (e.g., mono, stereo, surround).

The output device 470 is configured to receive the output signal 462 from the mixer and may comprise a set top box, console, visual output device (e.g., monitor, television, display), or audio output device (e.g., speaker).

Figure 5:
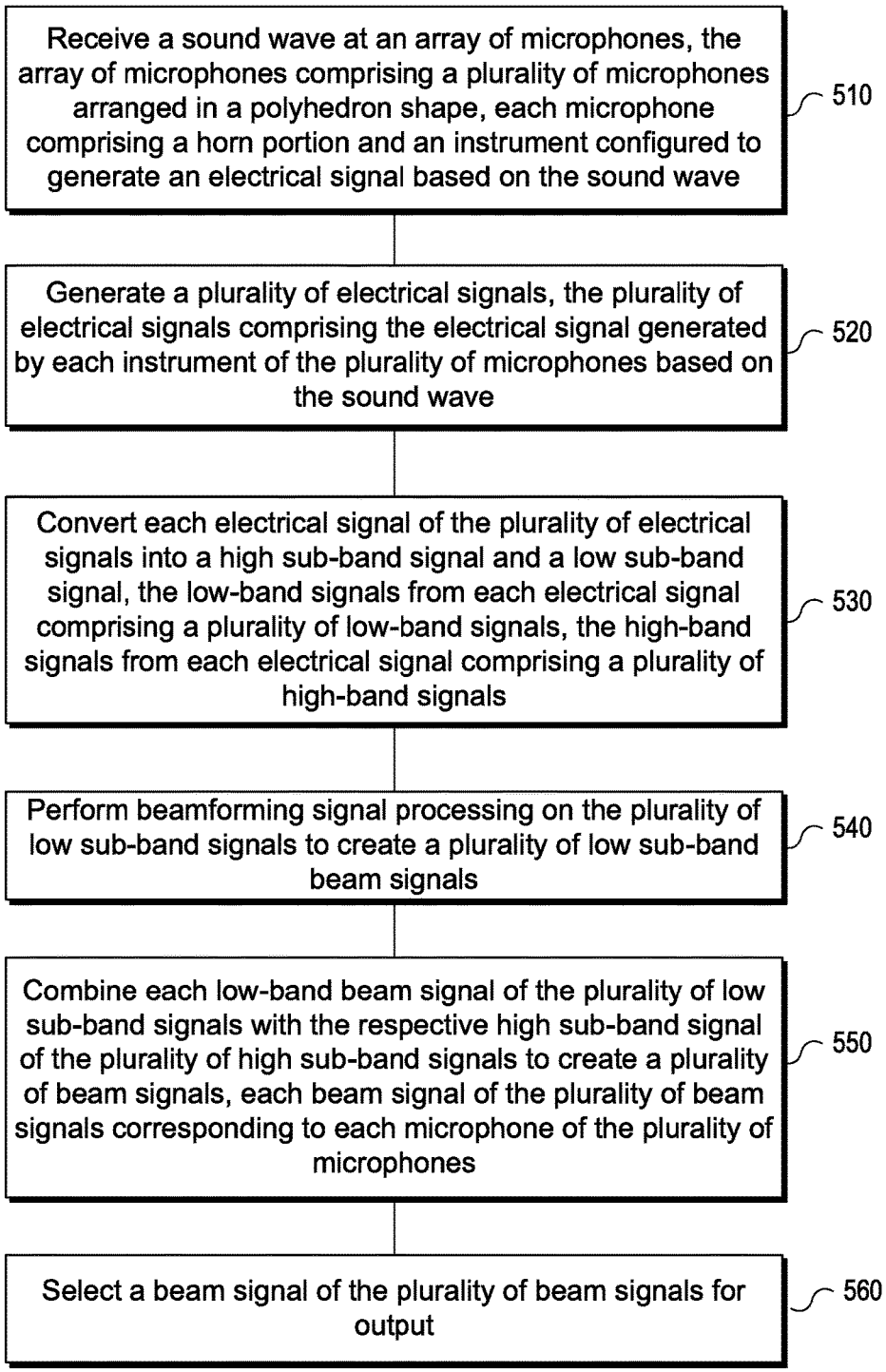
FIG. 5 depicts an example method for processing signals representing sound waves, in accordance with various aspects of the subject technology.

FIG. 5 depicts an example method 500 for processing signals representing sound waves, in accordance with various aspects of the subject technology. It should be understood that, for any process discussed herein, there can be additional, fewer, or alternative steps performed in similar or alternative orders, or in parallel, within the scope of the various embodiments unless otherwise stated.

At operation 510, a sound wave is received at an array of microphones. The array of microphones comprise a plurality of microphones arranged in a polyhedron shape, as shown for example, in FIG. 3. Each microphone may comprise a horn portion and an instrument, the instrument configured to generate an electrical signal based on the sound wave. The horn portion may comprise a plurality of planar surfaces that are arranged to form the polyhedron shape.

At operation 520, a plurality of electrical signals are generated based on the received sound wave. The plurality of electrical signals comprise the electrical signal generated by each instrument of the plurality of microphones.

At operation 530, each electrical signal of the plurality of electrical signals is converted into a high sub-band signal and a low sub-band signal. The electrical signal generated by each instrument and microphone, is thus converted to two signals, the high sub-band signal and the low sub-band signal. Each of the low-band signals, together, comprise a plurality of low-band signals. Similarly, each of the high-band signals, together, comprise a plurality of high-band signals.

At operation 540, beamforming signal processing is performed on the plurality of low sub-band signals to create a plurality of low sub-band beam signals. Stated differently, each of the low-band signals undergoes beamforming signal processing to thereby create a low sub-band beam signal. As described above, beamforming signal processing may comprise use of spherical harmonics theory or sound field models, use of array response vectors for various sound arrival angles in an anechoic chamber, and/or use of various types of beam pattern synthesis/optimization or machine learning.

At operation 550, each low-band beam signal of the plurality of low sub-band signals is combined with the respective high sub-band signal of the plurality of high sub-band signals to create a plurality of beam signals. Each beam signal of the plurality of beam signals corresponds to each microphone of the plurality of microphones of the array.

At operation 560, one or more beam signals of the plurality of beam signals is elected for output to an output device.

The functions described above can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing the functions and operations according to these disclosures may comprise hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The invention claimed is:

1. A system for converting sound waves, the system comprising:

an array of microphones, the array comprising a plurality of microphones, each microphone of the plurality of microphones comprising:

a horn portion comprising at least three planar surfaces, the surfaces arranged in a converging orientation to form a shape having a first opening at a proximal end and a second opening at a distal end, the second opening at the distal end being smaller in area than the first opening at the proximal end; and an instrument disposed at the distal end of the horn portion, the instrument configured to convert sound waves into an electrical signal;

the microphones of the array are radially disposed around a central point to define a polyhedron shape and oriented to direct received sound waves to that central point; and a beamforming signal processing circuit electrically coupled to each instrument of the plurality of microphones and configured to create a plurality of beam signals based on the respective electrical signals of each instrument.

2. The system of claim 1, wherein the beamforming signal processing circuit comprises a crossover filter, a processor, a delaying circuit, and a mixer.

3. The system of claim 2, wherein the crossover filter is configured to convert the electrical signal from each instrument of the plurality of microphones to respective first signals and second signals.

4. The system of claim 3, wherein the processor is configured to:

downsample each of the first signals from the crossover filter to create respective downsampled first signals;

process each of the downsampled first signals to create respective processed first signals, the processed first signals indicative of a location of the source of the sound waves detected by the respective instrument; and upsampled each of the processed first signals to create respective upsampled first signals.

5. The system of claim 4, wherein the delaying circuit is configured to delay each of the second signals from the crossover filter to create respective delayed second signals.

6. The system of claim 5, wherein the mixer is configured to combine each of the upsampled first signals from the processor with corresponding delayed second signals from the delaying circuit to create the plurality of beam signals.

7. The system of claim 1, further comprising an audio processing circuit, the audio processing circuit configured to perform at least one of an echo control filer, a reverberation filter, or a noise reduction filter, to the plurality of beam signals from the beamforming signal processing circuit.

8. The system of claim 1, wherein the shape of the horn portion formed by the plurality of surfaces comprises a square pyramid having four interior faces.

9. The system of claim 1, wherein the shape of the horn portion formed by the plurality of surfaces comprises a pentagonal pyramid having five interior faces.

10. The system of claim 1, wherein the shape of the horn portion formed by the plurality of surfaces comprises a hexagonal pyramid having six interior faces.

11. The system of claim 1, wherein each beam signal of the plurality of beam signals is indicative of a location of a source of the sound waves detected by each respective instrument.

12. A microphone array comprising:

a plurality of microphones arranged to form an array, the microphones of the array being radially disposed around a central point to define a polyhedron shape and oriented to direct received sound waves to that central point, each microphone of the plurality of microphones comprising;

a horn portion comprising a at least three planar surfaces, the planar surfaces arranged in a converging orientation to form a shape having a first opening on a proximal end and a second opening on a distal end, the second opening on the distal end being smaller in area than the first opening on the proximal end; and an instrument disposed on the distal end of the horn portion, the instrument configured to detect sound waves and convert sound waves into an electrical signal;

a beamforming signal processing circuit electrically coupled to each instrument of plurality of microphones, the beamforming signal processing circuit configured to:

receive a plurality of electrical signals, the plurality of electrical signals comprising the electrical signal from each microphone of the plurality of microphones; and create a plurality of beam signals based on the plurality of electric signals each beam signal of the plurality of beam signals corresponding to the electrical signal from each microphone of the plurality of microphones.

13. The microphone array of claim 12, wherein the beamforming signal processing circuit comprises a crossover filter, a processor, a dealying circuit, and a mixer.

14. The microphone array of claim 12, further comprising an audio processing circuit, the audio processing circuit configured to perform at least one of an echo control filter, a reverberation filter, or a noise reduction filter, to the plurality of beam signals from the beamforming signal processing circuit.

15. The microphone array of claim 12, further comprising an automatic mixer, the automatic mixer configured to receive the plurality of beam signals and identify a beam signal from the plurality of beam signals based on a characteristic of the beam signal.

16. The microphone array of claim 12, wherein the shape of the horn portion of each microphone of the plurality of microphones comprises a pentagonal pyramid having five interior faces.

17. The microphone array of claim 12, wherein the array comprises a polyhedron shape.

18. The microphone array of claim 17, wherein the polyhedron shape comprises a half dodecahedron.

19. The microphone array of claim 12, wherein each beam signal is indicative of a location of a source of the sound waves detected by each microphone of the plurality of microphones.

20. A method for creating a plurality of beam signals, the method comprising:

receiving a sound wave at an array of microphones, the array of microphones comprising a plurality of microphones each having a horn portion comprising at least three planar surfaces radially disposed around a central point to define a polyhedron shape and oriented to direct received sound waves to that central point, each microphone comprising a horn portion and an instrument, the instrument configured to generate an electrical signal based on the sound wave;

generating a plurality of electrical signals based on the received sound wave, the plurality of electrical signals comprising the electrical signal generated by each instrument of the plurality of microphones;

converting each electrical signal of the plurality of electrical signals into a high sub-band signal and a low sub-band signal, the low sub-band signals from each electrical signal comprising a plurality of low sub-band signals, the high sub-band signals from each electrical signal comprising a plurality of high sub-band signals;

performing beamforming signal processing on the plurality of low sub-band signals to create a plurality of low sub-band beam signals;

combining each low-band beam signal of the plurality of low sub-band signals with the respective high sub-band signal of the plurality of high sub-band signals to create a plurality of beam signals, each beam signal of the plurality of beam signals corresponding to each microphone of the plurality of microphones of the array; and selecting an output beam signal from the plurality of beam signals for output to an output device.

* * * * *